US005460143A

United States Patent [19]

Narita

[11] Patent Number: 5,460,143

[45] Date of Patent: Oct. 24, 1995

[54] FAULT-DIAGNOSING DEVICE FOR EVAPORATION SYSTEM

[75] Inventor: Masaki Narita, Shizuoka, Japan

[73] Assignee: Suzuki Motor Corporation, Shizuoka, Japan

[21] Appl. No.: 301,189

[22] Filed: Sep. 6, 1994

[30] Foreign Application Priority Data

Oct. 30, 1993 [JP] Japan ..... 5-294340

[51] Int. Cl.[6] ..... F02M 33/02

[52] U.S. Cl. ..... 123/520; 123/516

[58] Field of Search ..... 123/520, 521, 123/516, 518, 519, 198 D

[56] References Cited

U.S. PATENT DOCUMENTS

| | | | |
|---|---|---|---|
| 5,150,686 | 9/1992 | Okawa | 123/520 |
| 5,195,495 | 3/1993 | Kitamoto | 123/520 |
| 5,261,279 | 11/1993 | Lipinski | 123/520 |
| 5,295,472 | 9/1994 | Otsuka | 123/520 |
| 5,313,925 | 5/1994 | Otsuka | 123/520 |
| 5,315,980 | 5/1994 | Otsuka | 123/520 |
| 5,327,873 | 7/1994 | Ohuchi | 123/520 |
| 5,359,980 | 11/1994 | Tomisawa | 123/520 |

FOREIGN PATENT DOCUMENTS 4-362264 12/1992 Japan .

*Primary Examiner*—Carl S. Miller

*Attorney, Agent, or Firm*—Flynn, Thiel, Boutell & Tanis

[57] ABSTRACT

A fault-diagnosing device for an evaporation system which is adapted to minimize variations in pressure within a fuel tank and improve the accuracy of diagnosis for determining leakage. To this end, a control section is provided with an additional function for setting purging duty to a predetermined fixed value when determination conditions are fulfilled, the predetermined fixed value being varied in accordance with temperatures and residual fuel amounts. The control section is further provided with an additional function for monitoring a pressure gradient within the fuel tank when a negative pressure is established within the fuel tank, whereby the purging duty is feedback-controlled in accordance with the monitored pressure gradient.

2 Claims, 7 Drawing Sheets

FAULT-DIAGNOSING DEVICE FOR EVAPORATION SYSTEM

FIELD OF THE INVENTION

This invention relates to a fault-diagnosing device for an evaporation system and, more particularly, to a fault-diagnosing device for an evaporation system which is designed to minimize variations in pressure within a fuel tank and enhance the accuracy of diagnosis for determining leakage.

BACKGROUND OF THE INVENTION

Evaporating fuel, which leaks into the air from a fuel tank, a carburetor float chamber, and the like, contains a large quantity of hydrocarbons (HC). The evaporating fuel is described as one of causes of air pollution, and is also responsible for fuel loss. Accordingly, various techniques for preventing such occurrence are known, and there is an evaporation system representative of one such technique. In the evaporation system, evaporating fuel from the fuel tank is at first absorbed and retained in a canister that contains an absorbent such as activated carbon. Thereafter, the absorbed and retained fuel is released (purged) from the canister during operation of an internal combustion engine, thereby supplying the fuel to the engine.

As a fault-diagnosing device for the above evaporation system, one example is disclosed in Japanese Patent Application Laid-Open No. 4-362264. According to the fault-diagnosing device disclosed in this publication, a diagnosis control valve is closed while a purging control valve is opened immediately after engine start-up and at an engine temperature not exceeding a predetermined value. A negative pressure is thereby introduced from an air intake tube into a vapor passageway. Then, the purging control valve is opened and retained in that position for some period of time. In this way, failures are detected on the basis of variations in a pressure level within the above definite period of time. As a result, a small amount of vapor leakage as well as a large amount of vapor leakage from the entire evaporation system including the vapor passageway is detected without possible misdiagnosis.

Now, a course of action for diagnosing failures, which is provided by conventional fault-diagnosing devices for evaporation systems, will be described with reference to a time chart of FIG. 6.

Basically, an air open-close solenoid valve for the canister, which functions as a valve for receiving and blocking ambient air, is initially closed to establish a negative pressure within a fuel tank via purging duty. Values of the purging duty are defined by a traveling state.

When a predetermined level of negative pressure is achieved within the fuel tank, more specifically, when the internal pressure of the fuel tank is equal to a preselected pressure level, the purging duty is set to zero so as to detect subsequent pressure variations after a predetermined period of time elapses. Thus, any leakage from the evaporation system is diagnosed.

That is, assume that the internal pressure of the fuel tank is PT1 when the air open-close solenoid valve for the canister provides a closing action. Further, assume that the internal pressure of the fuel tank is PT2 when the purging duty fluctuates. Then, situations such as evaporation differences due to gasoline properties or capacities are assessed on the basis of the result of PT2 minus PT1.

In addition, assume that the internal pressure of the fuel tank is PT3 when the purging duty is taken as zero. Then, it is ascertained how a purging valve and the air open-close solenoid valve behave while the internal pressure varies from PT2 to PT3.

Moreover, assume that the internal pressure of the fuel tank is PT4 when the air open-close solenoid valve for the canister provides an opening action in response to detection of pressure variations after the predetermined period of time elapses from the moment the internal pressure of the tank achieves a preselected level of pressure. Then, the result of PT4 minus PT3 determines leakage from the tank.

At the final stage, it is determined whether or not the equation (PT4-PT3)-(PT2-PT1) exceeds a predetermined value. When the result is positive, a determination is made that there is a leak.

However, the purging duty for establishing the negative pressure within the fuel tank employs a purging efficiency map which is identical to that used for a normal traveling period. As a result, there is an inconvenience in that a purging efficiency indicative of the purging duty varies with the traveling state.

Consequently, another inconvenience arises in which a high temperature of outside air and a large amount of gasoline evaporation within the fuel tank preclude the pressure within the fuel tank from dropping to a predetermined level of negative pressure. (See light lines of FIG. 7.)

Conversely, when leakage is determined at a low temperature of outside air and a high purging efficiency, there is an inconvenience in that the predetermined level of negative pressure within the fuel tank is reached at such a rapid velocity that an undershooting of the pressure is created so as to preclude stable pressure measurement. (See broken lines of FIG. 7.) This is disadvantageous in practical use.

To obviate the above-described inconveniences, one aspect of the present invention provides a fault-diagnosing device for an evaporation system, in which a canister for absorbingly retaining evaporating fuel is disposed midway along a passageway intercommunicating an air intake passageway of an internal combustion engine and a fuel tank, an air open-close valve being provided for the canister, the fault-diagnosing device further having a control means for effecting control such that the air open-close valve is caused to close when determination conditions are fulfilled, thereby establishing a negative pressure within the fuel tank on the basis of purging duty, and that the purging duty is set to be zero when a predetermined level of pressure is achieved within the fuel tank, thereby detecting a leaking state on the basis of pressure variations that occur after purging is ceased, the fault-diagnosing device being characterized in that the control means is provided with an additional function for setting the purging duty to a predetermined fixed value when the determination conditions are met, the predetermined fixed value being varied in accordance with temperatures and residual fuel amounts.

Another aspect of the present invention provides a fault-diagnosing device for an evaporation system, in which a canister for absorbingly holding evaporating fuel is placed midway along a passageway intercommunicating an air intake passageway of an internal combustion engine and a fuel tank, an air open-close valve being provided for the canister, the fault-diagnosing device further having a control means for effecting control such that the air open-close valve is caused to close when determination conditions are fulfilled, thereby establishing a negative pressure within the fuel tank on the basis of purging duty, and that the purging duty is set to be zero when a predetermined level of pressure is achieved within the fuel tank, thereby detecting a leaking state on the basis of pressure variations that occur after purging is ceased, the fault-diagnosing device being characterized in that the control means is provided with an additional function for monitoring a pressure gradient within the fuel tank when the negative pressure is established within the fuel tank, whereby feedback control over the purging duty is effected in accordance with the monitored pressure gradient.

According to the present invention having the aforesaid structure, when determination conditions are fulfilled, purging duty is set to a predetermined fixed value which is varied in accordance with temperatures and residual fuel amounts. As a result, variations in the purge duty are eliminated, which provides improved precision for determination.

In addition, when a negative pressure is established within the fuel tank, a gradient of the pressure therein is monitored to provide feedback control of the purging duty in accordance with the monitored pressure gradient. As a result, variations in the purging duty are eliminated, which provides enhanced precision for determination.

DETAILED DESCRIPTION

Embodiments of the present invention will be described hereinbelow with reference to the drawings.

Figure 1:
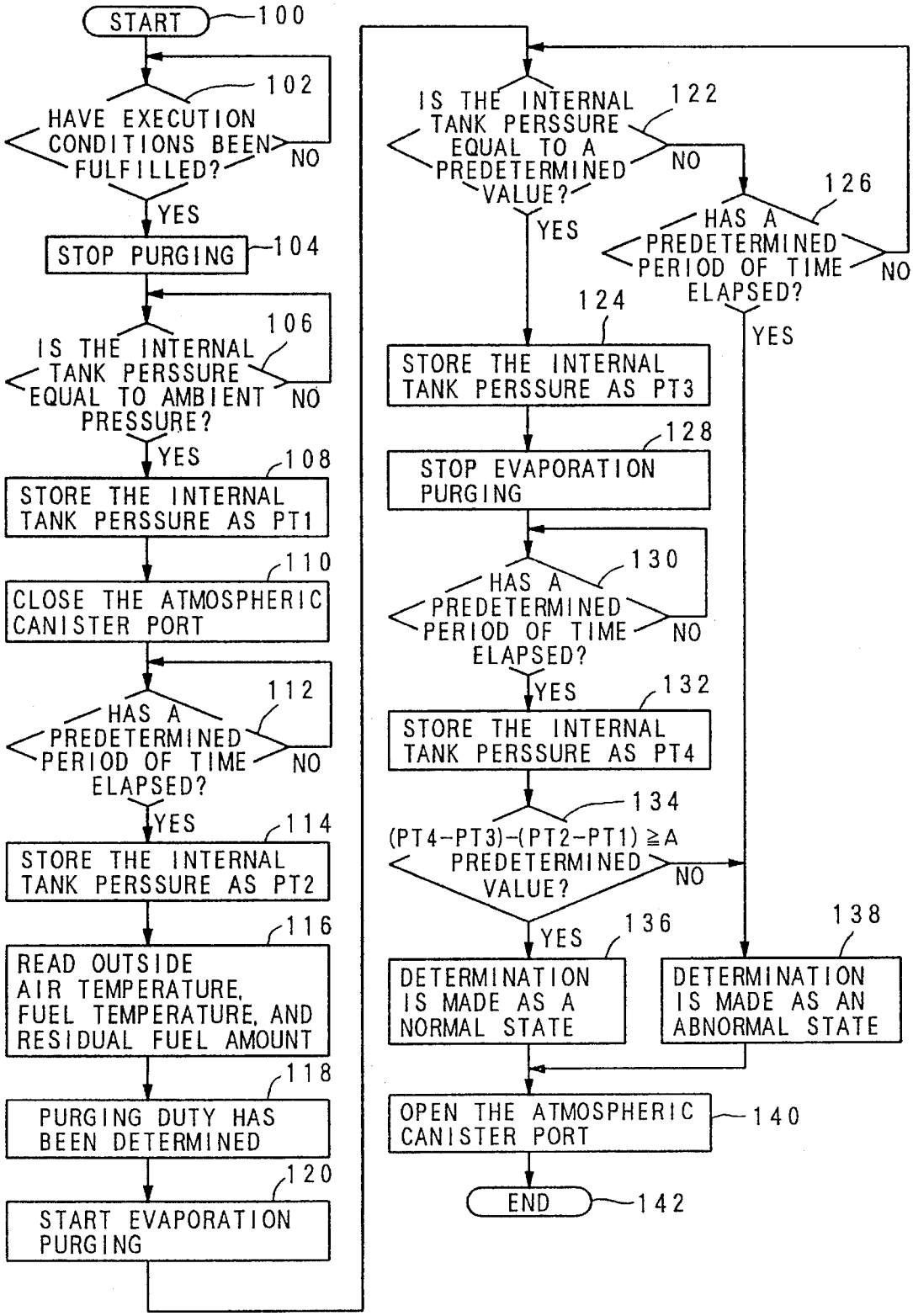
FIG. 1 is a control flow chart for a fault-diagnosing device for an evaporation system, illustrating a first embodiment of the present invention.
Figure 2:
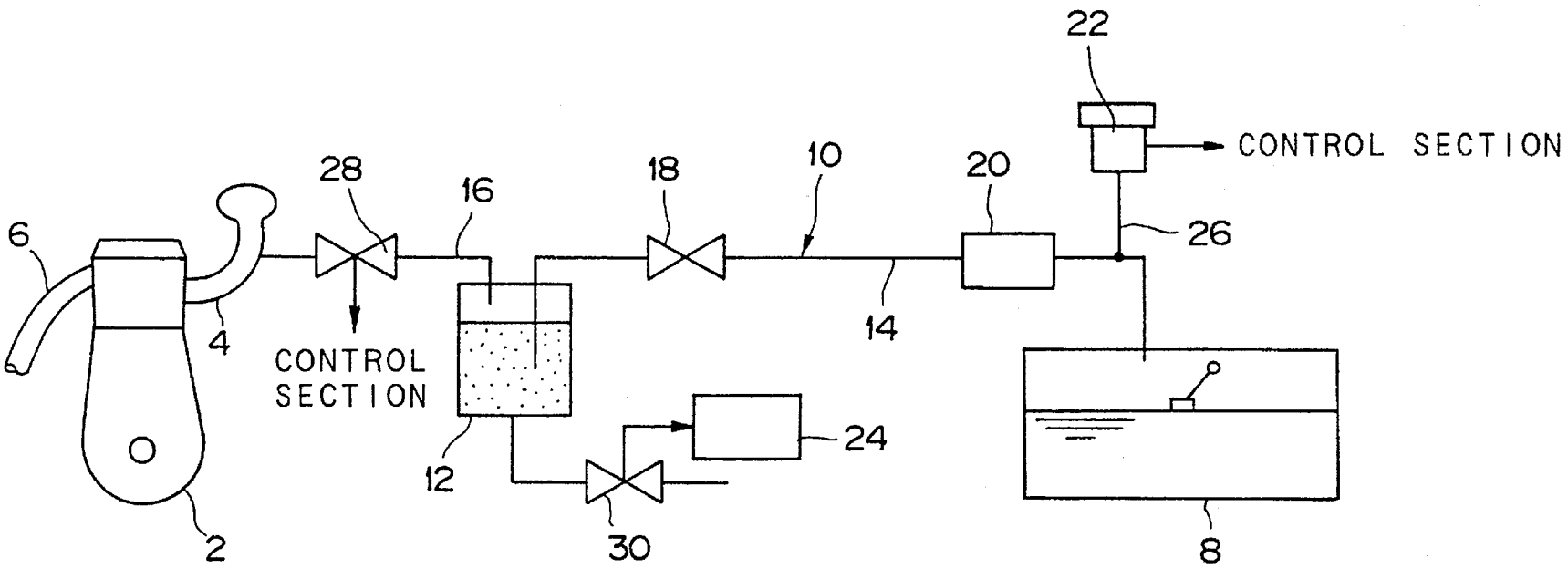
FIG. 2 is a schematic block diagram illustrating the fault-diagnosing device.
Figure 3:
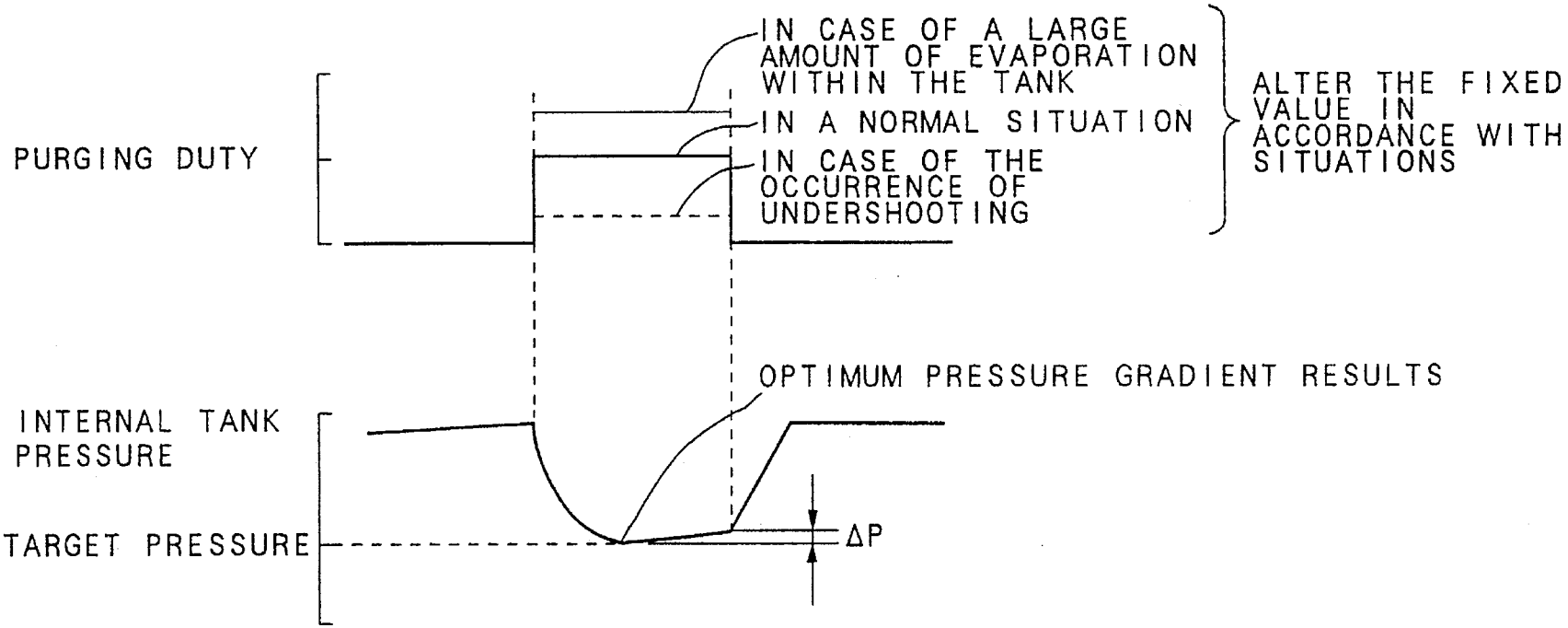
FIG. 3 is a time chart for the fault-diagnosing device.

FIGS. 1 through 3 illustrate a first embodiment of the present invention. In FIG. 2, reference numerals 2, 4, 6, and 8 denote an internal combustion engine, an air intake passageway, an air exhaust passageway, and a fuel tank, respectively.

The internal combustion engine 2 has a fuel injection valve (not shown) disposed in the air intake passageway 4, with the fuel injection valve being directed toward a combustion chamber (not shown). The fuel injection valve communicates with the fuel tank 8 via a fuel passageway (not shown). A fuel pump (not shown) pumps fuel from the fuel tank 8 into the fuel injection valve through the fuel passageway. The fuel is then supplied together with air to the combustion chamber for combustion therein. The resulting discharge gases are discharged through the air exhaust passageway 6.

There is provided a passageway arrangement 10 which intercommunicates the air intake passageway 4 of the internal combustion engine 2, for example, on a downstream side of an unillustrated throttle valve, and the fuel tank 8. Further, a canister 12 for absorbingly retaining evaporating fuel is placed midway along the passageway arrangement 10.

The passageway arrangement 10 is formed by first and second passageways 14 and 16. The first passageway 14 intercommunicates the fuel tank 8 and the canister 12, and functions as an evaporation line. The second passageway 16 intercommunicates the canister 12 and the air intake passageway 4, and serves as a purging line.

Further, a first solenoid valve 18 and a separator 20 are arranged midway along the first passageway 14 in this order from the side of the canister 12. The first solenoid valve 18 is a pressure control valve. In addition, there are provided a pressure sensor 22 and a control section 24. The pressure sensor 22 communicates with the first passageway 14 between the fuel tank 8 and the separator 20. When preselected determination conditions are satisfied, the control section 24 effects control such that the first solenoid valve 18 is opened to intercommunicate the air intake passageway 4 and the pressure sensor 22.

As shown in FIG. 2, the pressure sensor 22 is in communication between the fuel tank 8 and the separator 20 via a pressure-detecting passageway 26.

Meanwhile, the control section 24 is connected respectively to: the first solenoid valve 18; the pressure sensor 22; a second solenoid valve 28 for purging, which is disposed midway along the second passageway 16; and a third solenoid valve 30, which is an air open-close valve for the canister 12.

When preselected determination conditions, for example, all of the following, are satisfied, that is, in order to reduce an influence on exhaust gases or drivability, the control section 24 determines that determination conditions for initiating leakage diagnosis have been fulfilled:

(1) for water temperature Tw, $Tw>Tw_2$, where $Tw_2$ is a preset water temperature;

(2) for vehicle velocity V, $V_1 \leqq V \leqq V_2$, where $V_1$ and $V_2$ are first and second preset vehicle velocities, respectively;

(3) for vehicle velocity fluctuation $\Delta v$ for t second, $\Delta v<v$, where v is a preset vehicle velocity fluctuation;

(4) an idle switch (ID SW) being in an OFF state; and, (5) for internal tank pressure P (a gauge pressure), $P>Pt$, where Pt is a preset internal tank pressure (a gauge pressure).

After the above determination, the control section 24 closes the second solenoid valve 28 for purging. At the same time, the control section 24 opens the first solenoid valve 18, thereby permitting the air intake passageway 4 to be communicated with the pressure sensor 22. Next, the control section 24 establishes a negative pressure within the fuel tank 8 in accordance with purging duty. When a predetermined level of pressure is achieved within the fuel tank 8, the control section 24 sets the purging duty to zero. As a result, the presence of any leak is detected and determined on the basis of pressure variations that occur after purging is stopped.

It is to be noted that when the aforesaid determination conditions are fulfilled, the purging duty is set to a predetermined fixed value that is varied in accordance with temperatures and residual fuel amounts. To this end, the control section 24, which acts as a control means, is constructed to serve the above additional function.

In greater detail, as shown by a solid line in FIG. 3, the control section 24 functions to set the purging duty to the preselected fixed value when the determination conditions are met.

In addition, the fixed value is alterable depending on situations of temperatures, such as outside air temperature or fuel temperature, and residual fuel amounts. To be specific, the fixed value is varied to a slightly greater degree, as indicated by a light line in FIG. 3, when gasoline within the fuel tank 8 evaporates in large quantities. On the other hand, the fixed value is varied to a somewhat smaller degree when under-shooting occurs, as shown by a broken line in FIG. 3.

As a result, pressure within the fuel tank 8, i.e., internal tank pressure, assumes an optimum pressure gradient.

Next, the operation of the first embodiment of a fault-diagnosing device for an evaporation system will be described with reference to a control flow chart of FIG. 1.

A program for the for the control flow chart starts with step 100 when the internal combustion engine 2 is brought into start-up operation.

The program is advanced to step 102 at which it is determined whether or not execution conditions, i.e., determination conditions for initiating leakage diagnosis, have been fulfilled.

When the determination in step 102 is "NO" the determination in the step is repeatedly made until turning to "YES". When the determination in step 102 is "YES" the program is advanced to step 104 at which the second solenoid valve 28 for purging is closed to cease the purging.

Following step 104 of stopping the purging, there is step 106 at which it is determined whether or not a pressure within the fuel tank 8, i.e., an internal tank pressure, is equal to ambient pressure. When the determination in step 106 is "NO", the determination in the step is repeatedly made until turning to "YES". When the determination in step 106 results in "YES" the program is advanced to step 108 where the internal tank pressure is stored as PT1. The program is further advanced to step 110 of closing an atmospheric canister port, i.e., the third solenoid valve 30 acting as an air open-close valve for the canister 12.

At the next step 112, it is determined whether or not a first predetermined period of time has elapsed. The first predetermined period of time is established in advance When the determination in step 112 is "NO" the determination in the step is repeatedly made until turning to "YES". When the determination in step 112 is "YES" the program is advanced to step 114 where the internal tank pressure is stored as PT2. The program is further advanced to step 116 for reading outside air temperature, fuel temperature, and residual fuel amount.

At subsequent step 118, a fixed value for purging duty is determined on the basis of the above-read temperatures. Then, evaporation purging is initiated at step 120.

In the evaporation purging, the program is initially advanced to step 122 where it is determined whether or not the internal tank pressure has dropped to a level equal to a first predetermined value. When the determination in the step is "YES", the program is advanced to step 124 where the internal tank pressure at a precise point to match the first predetermined value is stored as PT3. When the determination in step 122 is "NO" the program is shifted to step 126 where it is determined whether or not a second predetermined period of time for ascertaining valve actuation has elapsed. The second predetermined period of time is set up in advance.

Now, the determination in step 126 will be described When the determination in this step is "NO" the program is returned to the previous step 122 where it is determined whether or not a drop in the internal tank pressure reaches the first predetermined value. However, when the determination in step 126 is "YES", the program is advanced to step 138 where it is determined that an abnormal state has developed because a drop in the internal tank pressure does not reach the first predetermined value. The program is further advanced to step 140 of opening the third solenoid valve 30.

Following the aforesaid step 124 of storing the internal tank pressure as PT3, there is step 128 at which the evaporation purging is ceased. Then, the program is advanced to step 130 where it is determined whether or not a third predetermined period of time has elapsed since the internal tank pressure was stored as PT3 at the preceding step 124.

When the determination in step 130 is "NO" the determination in the step is repeatedly made until turning to "YES". When the determination in step 130 is "YES" the program is advanced to step 132 where the internal tank pressure is stored as PT4.

Next, the program is advanced to step 134 at which a determination is made in order to check for leakage from the tank, which determination is made from the following equation: (PT4-PT3)-(PT2-PT1)≧ a predetermined value. When the determination in step 134 is "NO" it proves that leakage has occurred. Then, the program is advanced to step 138 where it is determined that an abnormal state has developed. However, when the determination in step 134 is "YES", it is determined at step 136 that a normal state occurs.

The program is then advanced to step 140 for opening the third solenoid valve 30. After the valve 30 is opened, the control flow chart program ends with step 142.

In conclusion, when the determination conditions are fulfilled, the control section 24 sets the purging duty to a preselected fixed value which is varied in accordance with temperatures and remaining fuel amount. As a result, variations in the pressure within the fuel tank 8 are avoided, which can enhance the precision of diagnosis for determining the leakage. This is advantageous in view of practical use.

In addition, the above processing can be accomplished via only changes in the program that is installed in the control section 24. This feature provides an uncomplicated structure which is easy to fabricate and which can maintain low cost. This is also advantageous from an economical viewpoint.

Furthermore, the longest period of time for establishing a negative pressure within the fuel tank 8 is set to an optimum value. This feature reduces an influence on exhaust gases, and obviates the likelihood of discharging a large amount of harmful components.

Figure 4:
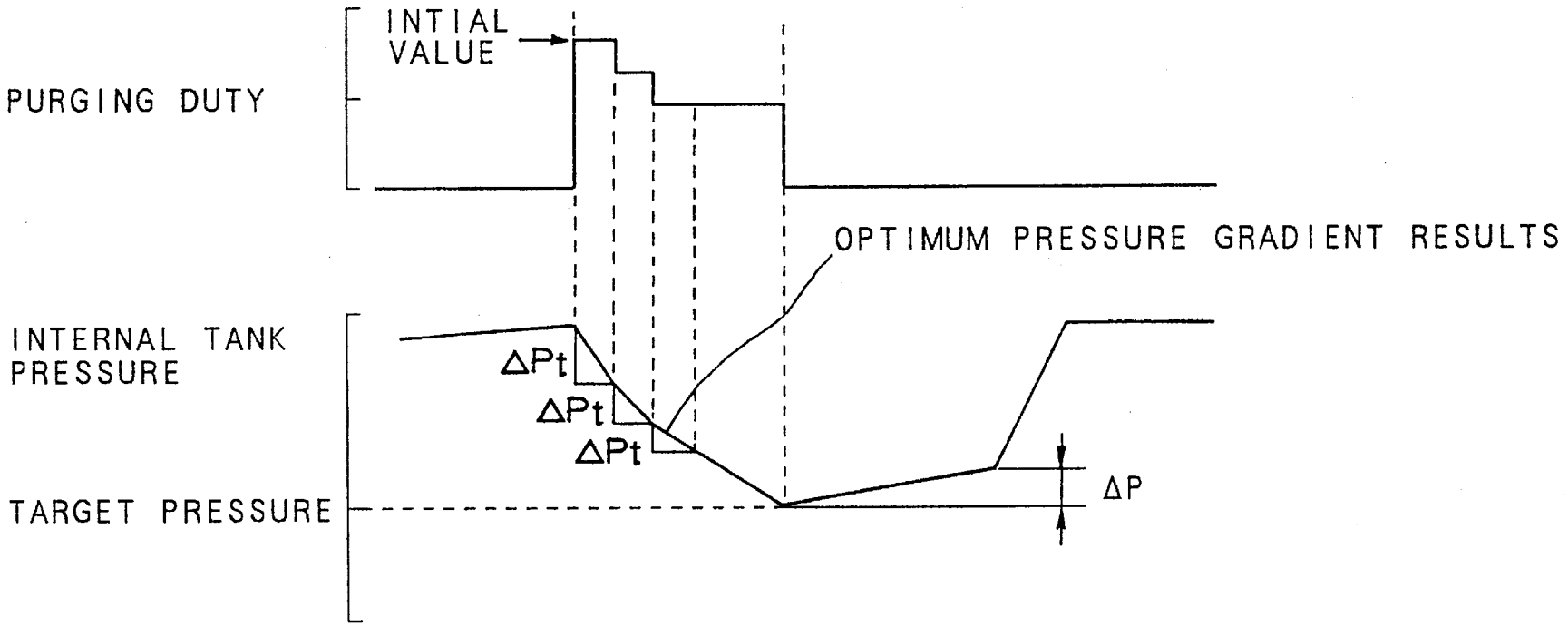
FIG. 4 is a time chart for a fault-diagnosing device for an evaporation system, and illustrating a second embodiment of the present invention.
Figure 5:
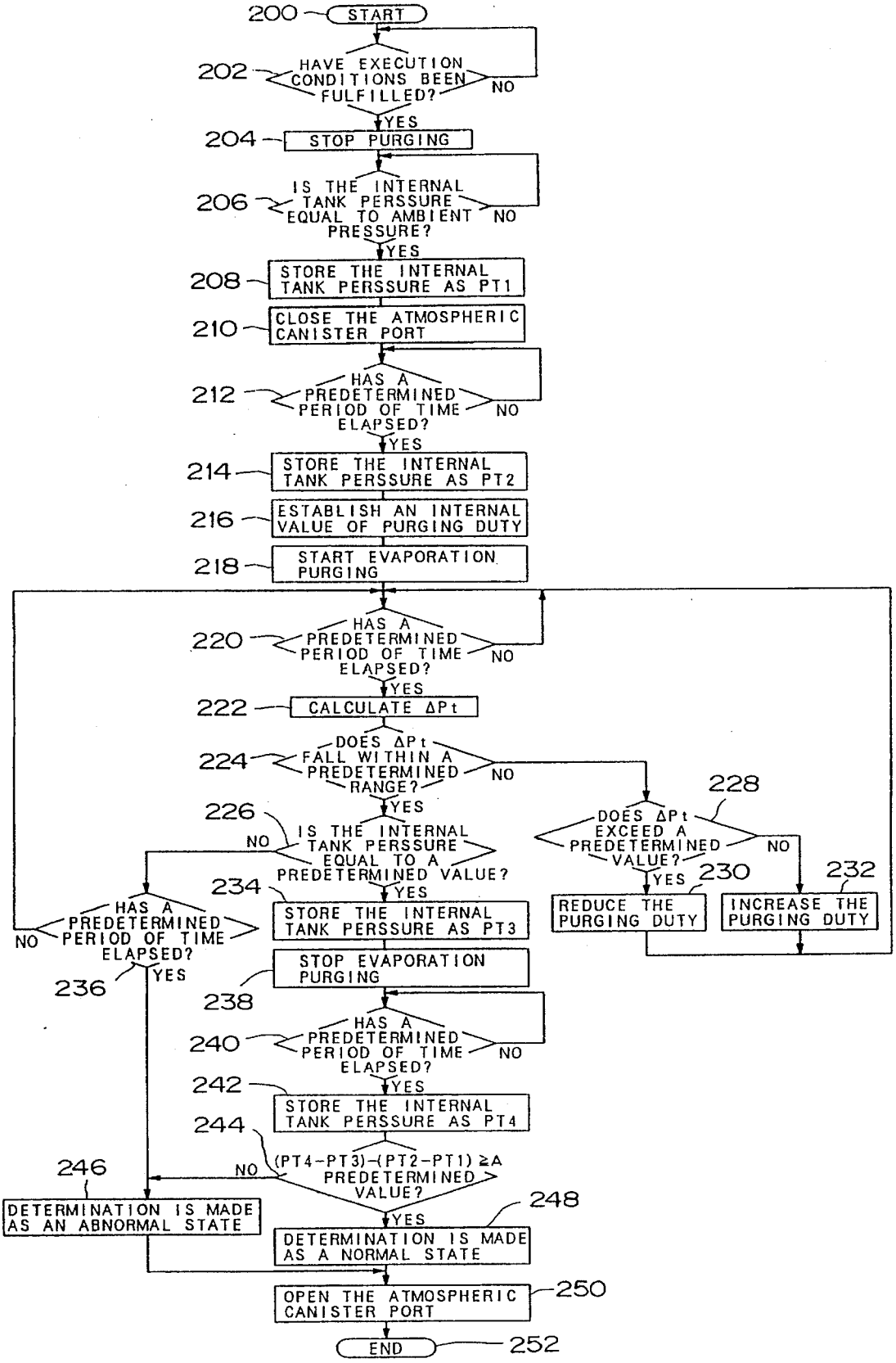
FIG. 5 is a control flow chart for the fault-diagnosing device.
Figure 6:
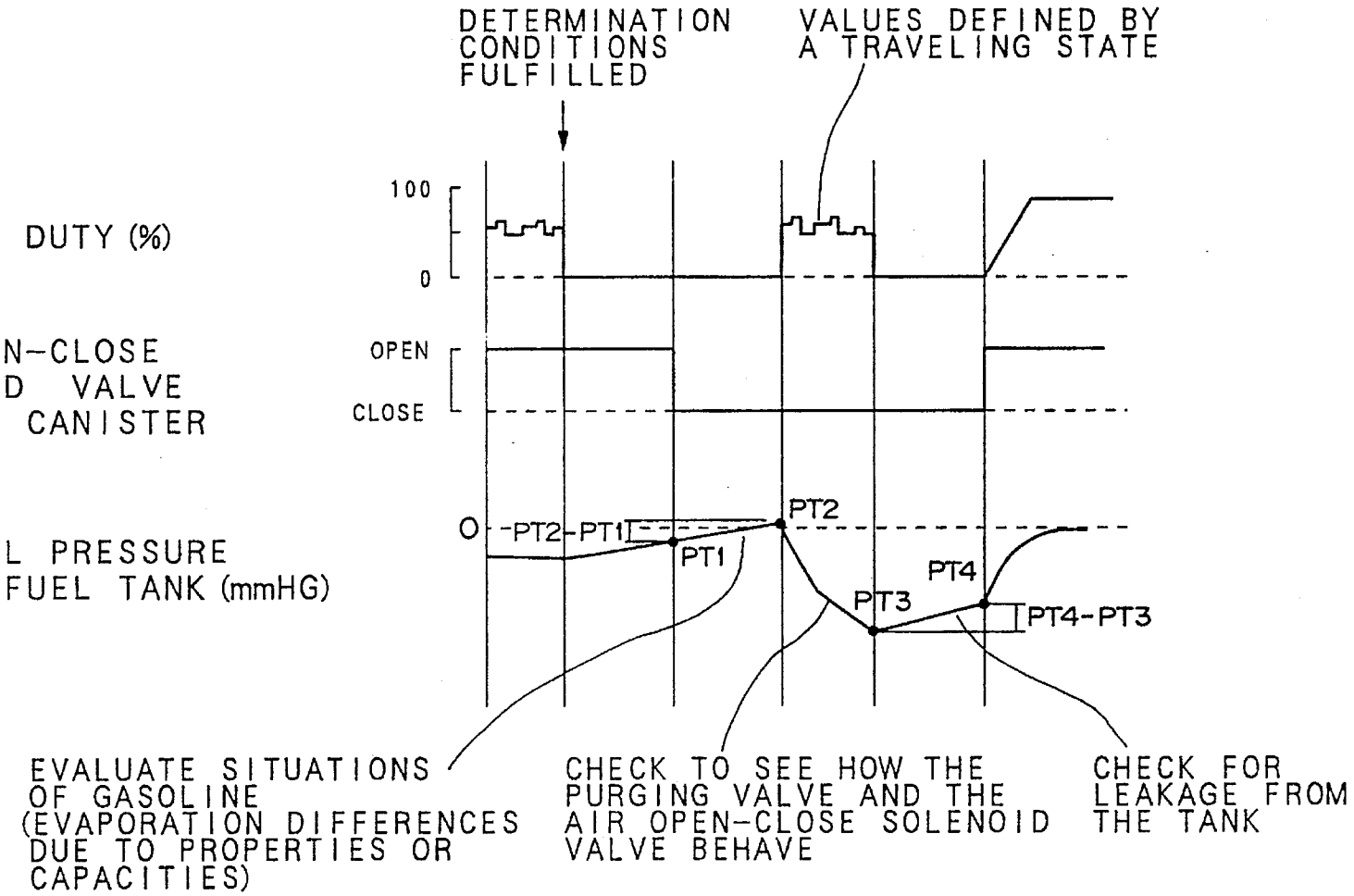
FIG. 6 is a time chart additionally including opening and closing actions of an air open-close solenoid valve for a canister in a fault-diagnosing device for an evaporation system, and illustrating the prior art that underlies the present invention.
Figure 7:
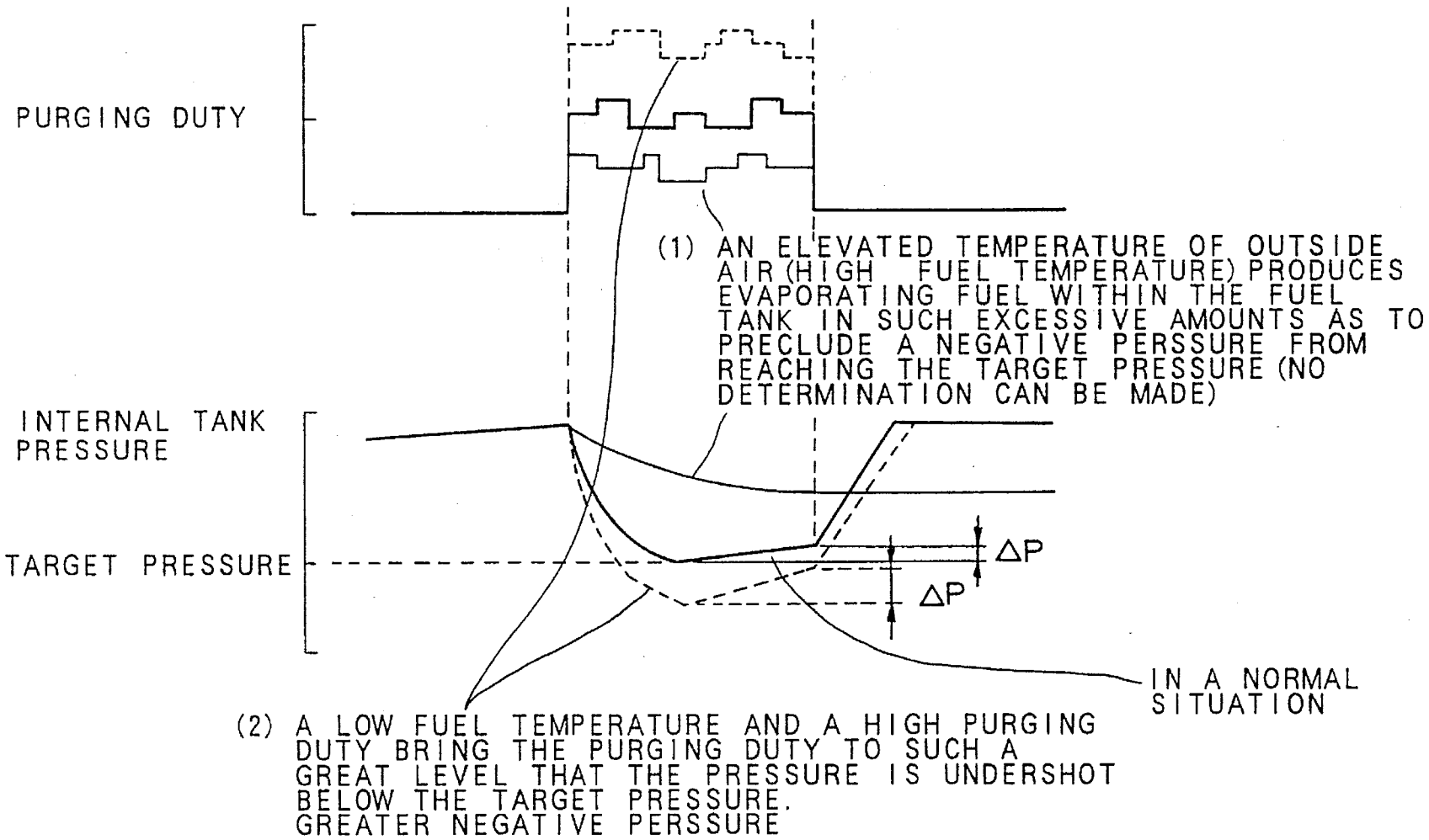
FIG. 7 is a time chart for the fault-diagnosing device according to the prior art.

FIGS. 4 and 5 illustrate a second embodiment of the present invention. In this second embodiment the features thereof which are the same as in the preceding first embodiment are designated by the same reference numerals.

The second embodiment is characterized in that the control section is provided with an additional function for monitoring a pressure gradient within the fuel tank when a negative pressure is established within the fuel tank, whereby purging duty is feedback-controlled in accordance with the monitored pressure gradient.

That is, as shown in FIG. 4, when determination conditions are fulfilled, the purging duty is set to a preset initial value before purging is initiated. Then, comparison is made between a first pressure Pt, which corresponds after a predetermined period of time elapses, and a second pressure P told, which corresponds when purging is started, thereby calculating a pressure gradient ΔPt. By comparing this pressure gradient APt with a predetermined value, the purging duty is feedback-controlled in such a manner that a given value of pressure gradient is provided when the negative pressure is established within the fuel tank.

Now, the operation of the second embodiment will be described with reference to a control flow chart of FIG. 5.

A program for the control flow chart starts with step 200 when the internal combustion engine is brought into starting operation.

The program is then advanced to step 202 where it is determined whether or not execution conditions, i.e., determination conditions for initiating leakage diagnosis, have been fulfilled. When the determination in step 202 is "NO", the determination in the step is repeatedly made until turning to "YES". When the determination in step 202 is "YES" the program is advanced to step 204 where a second solenoid valve for purging is closed to cease the purging.

Following step 204 of stopping the purging, there is step 206 at which it is determined whether or not a pressure within the fuel tank, i.e., an internal tank pressure, is equal to ambient pressure. When the determination in step 206 is "NO", the determination in the step is repeatedly made until turning to "YES". When the determination in step 206 is "YES", the program is advanced to step 208 where the internal tank pressure is stored as PT1. The program is further advanced to step 210 for closing the atmospheric port to the canister, i.e., closing the third solenoid valve which acts as an air open-close valve for the canister.

At the next step 212, it is determined whether or not a first predetermined period of time has elapsed. The first predetermined period of time is established in advance. When the determination in step 212 is "NO", the determination in the step is repeatedly made until turning to "YES". When the determination in step 212 results in "YES", the program is advanced to step 214 where the internal tank pressure is stored as PT2. The program is further advanced to step 216 where the purging duty is set to an initial value.

After step 216 of initializing the purging duty, evaporation purging is started at step 218.

In the evaporation purging, it is initially determined at step 220 whether or not a second predetermined period of time has elapsed. When the determination in step 220 is "NO", the determination in the step is repeatedly made until turning to "YES". When the determination in step 220 is "YES", the program is advanced to step 222 where pressure gradient ΔPt is calculated on the basis of comparison between pressures Pt and P told. Pt is established after the second predetermined period of time elapses. Ptold is established when the purging is started.

At subsequent step 224, it is determined whether or not pressure gradient ΔPt lies within a predetermined range When the determination in step 224 is "YES" the program is advanced to step 226 where it is determined whether or not the internal tank pressure has dropped to a level equal to a first predetermined value. However, when the determination in step 224 is "NO", the program is shifted to step 228 where it is determined whether or not pressure gradient ΔPt exceeds a second predetermined value.

Now, the determination in step 228 will be described. When the determination in this step is "YES", the program is advanced to step 230 where the purging duty is reduced, and is then returned to the previous step 220 where it is determined whether or not the second predetermined period of time has elapsed. When the determination in step 228. is "NO", the program is advanced to step 232 where the purging duty is increased, and is then returned to previous step 220 where the aforesaid determination is made.

Referring back to step 226 at which it is determined whether or not the internal tank pressure has dropped to the level equal to the first predetermined value, when the determination in step 226 is "YES", the program is advanced to step 234 where the internal tank pressure at a precise point to match the first predetermined value is stored as PT3. When the determination in step 226 is "NO", the program is shifted to step 236 where it is determined whether or not a third predetermined period of time for ascertaining valve actuation has elapsed. The third predetermined period of time is established in advance.

Now, the determination in step 236 will be described. When the determination in this step is "NO", the program is returned to previous step 220 where it is determined whether or not the second predetermined period of time has elapsed. However, when the determination in step 236 is "YES", the program is advanced to step 246 where it is determined that an abnormal state has developed because a drop in the internal tank pressure does not reach the first predetermined value. The program is further advanced to step 250 at which the third solenoid valve is opened.

Following the preceding step 234 of saving the internal tank pressure as PT3, there is step 238 at which the evaporation purging is stopped. At subsequent step 240, it is determined whether or not a fourth predetermined period of time has elapsed since the internal tank pressure was stored at PT3 at step 234.

When the determination in step 240 is "NO", the determination in the step is repeatedly made until turning to "YES". When the determination in step 240 is "YES" the program is advanced to step 242 where the internal tank pressure is saved as PT4. At the next step 244, a determination is made in order to check for leakage from the tank, which determination is made from the following equation: (PT4-PT3)-(PT2-PT1)≧ a predetermined value. When the determination in step 244 is "NO", it proves that leakage has occurred. Then, the program is advanced to step 246 where it is determined that an abnormal state has developed. However, when the determination in step 244 is "YES", the program is advanced to step 248 where it is determined that a normal state occurs.

The program is further advanced to step 250 where the third solenoid valve is opened. After the third solenoid valve is opened, the control flow chart program ends with step 252.

In conclusion, while establishing the negative pressure within the fuel tank, the control section monitors the gradient of the pressure therein. Then, the control section provides a feedback control of the purging duty in accordance with the monitored pressure gradient. As a result, an optimum pressure gradient without creating undershooting can be ensured, which can reduce variations in the pressure within the fuel tank. Accordingly, an enhanced accuracy of diagnosis for determining leakage is achievable. This is advantageous in practical use.

In addition, the above processing can be conducted via only changes in the program that is installed in the control section. As a result, an uncomplicated structure having features of each fabrication and low cost retention is provided in a manner similar to the preceding first embodiment. This is also advantageous from an economical viewpoint.

Furthermore, since the purging duty is feedback-controlled in accordance with the monitored pressure gradient, the time for establishing the negative pressure within the fuel tank can be set to an optimum value. Consequently, an influence on exhaust gases is reduced, which obviates the possibility that harmful components are discharged in large volumes.

The present invention is not limited to the aforesaid first and second embodiments, but is amenable for various applications and modifications.

For example, according to the first embodiment of the present invention, when determination conditions are established, the purging duty is set to a predetermined fixed value with temperatures, or rather an outside air temperature and a fuel temperature, and residual fuel amounts being employed as parameters. However, not all of the aforesaid temperatures and residual fuel amounts must be employed as parameters in order to set the purging duty to the fixed value. Alternatively, other detecting signals may be added to such parameters.

As detailed above, according to the present invention, there is provided a fault-diagnosing device for an evaporation system, in which a canister for absorbingly holding evaporating fuel is placed midway along a passageway intercommunicating an air intake passageway of an internal combustion engine and a fuel tank, an air open-close valve being provided for the canister, the fault-diagnosing device further having a control means for effecting control such that the air open-close valve is caused to close when determination conditions are fulfilled, thereby establishing a negative pressure within the fuel tank on the basis of purging duty, and that the purging duty is set to be zero when a predetermined level of pressure is achieved within the fuel tank, thereby detecting a leaking state on the basis of pressure variations that occur after purging is ceased, the fault-diagnosing device characterized in that the control means is provided with an additional function for setting the purging duty to a predetermined fixed value when the determination conditions are met, the predetermined fixed value being varied in accordance with temperatures and residual fuel amounts. Accordingly, when the determination conditions are fulfilled, the control means sets the purging duty to the predetermined fixed value that is varied in accordance with temperatures and remaining fuel amounts. As a result, variations in the pressure within the fuel tank are avoided, and the precision of diagnosis for determining leakage can be enhanced. This is advantageous in view of practical use. In addition, the above processing can be conducted via only changes in the program that is installed in the control means. This feature provides an uncomplicated structure which is easy of fabrication and which can maintain low costs. This is also advantageous from an economical viewpoint. Furthermore, the longest period of time for establishing the negative pressure within the fuel tank is set to an optimum value. As a result, there is a reduced influence on exhaust gases, which obviates the likelihood of discharging harmful components in large volumes.

Furthermore, there is provided a fault-diagnosing device for an evaporation system, in which a canister for absorbingly holding evaporating fuel is disposed midway along a passageway intercommunicating an air intake passageway of an internal combustion engine and a fuel tank, an air open-close valve being provided for the canister, the fault-diagnosing device further having a control means for effecting control such that the air open-close valve is caused to close when determination conditions are fulfilled, thereby establishing a negative pressure within the fuel tank on the basis of purging duty, and that the purging duty is set to be zero when a predetermined level of pressure is achieved within the fuel tank, thereby detecting a leaking state on the basis of pressure variations that occur after purging is ceased, the fault-diagnosing device characterized in that the control means is provided with an additional function for monitoring a pressure gradient within the fuel tank when the negative pressure is established within the fuel tank, whereby feedback control over the purging duty is effected in accordance with the monitored pressure gradient. Accordingly, while establishing the negative pressure within the fuel tank, the control means monitors a gradient of the pressure within the fuel tank. The control means then provides the feedback control of the purging duty on the basis of the monitored pressure gradient. This feature can ensure an optimum pressure gradient without creating undershooting, and consequently can reduce variations in the pressure within the fuel tank. As a result, the accuracy of diagnosis for determining leakage can be enhanced. This is advantageous in view of practical use. In addition, the above processing can be conducted via only changes in the program that is installed in the control means. This feature provides an uncomplicated structure which is easy of fabrication and which can maintain low costs. This is also advantageous from an economical viewpoint. Furthermore, since the purging duty is feedback-controlled in accordance with the monitored pressure gradient, the time for establishing the negative pressure within the fuel tank can be set to an optimum value. As a result, a reduced influence is exerted on exhaust gases, which obviates the likelihood of discharging a large amount of harmful components.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A fault-diagnosing device for an evaporation system, in which a canister for absorbingly holding evaporating fuel is placed midway along a passageway intercommunicating an air intake passageway of an internal combustion engine and a fuel tank, an air open-close valve being provided for said canister, said fault-diagnosing device further having a control means for providing control such that said air open-close valve is caused to close when determination conditions are fulfilled, thereby establishing a negative pressure within said fuel tank on the basis of purging duty, and that said purging duty is set to be zero when a predetermined level of pressure is achieved within said fuel tank, thereby detecting a leaking state on the basis of pressure variations that occur after purging is ceased, said fault-diagnosing device characterized in that said control means is provided with an additional function for setting said purging duty to a predetermined fixed value when said determination conditions are met, said predetermined fixed value being varied in accordance with temperatures and residual fuel amounts.

2. A fault-diagnosing device for an evaporation system, in which a canister for absorbingly holding evaporating fuel is disposed midway along a passageway intercommunicating an air intake passageway of an internal combustion engine and a fuel tank, an air open-close valve being provided for said canister, said fault-diagnosing device further having a control means for providing control such that said air open-close valve is caused to close when determination conditions are fulfilled, thereby establishing a negative pressure within said fuel tank on the basis of purging duty, and that said purging duty is set to be zero when a predetermined level of pressure is achieved within said fuel tank, thereby detecting a leaking state on the basis of pressure variations that occur after purging is ceased, said fault-diagnosing device characterized in that said control means is provided with an additional means for monitoring a pressure gradient within said fuel tank when said negative pressure is yielded within said fuel tank, to effect feedback control over said purging duty in accordance with said monitored pressure gradient.

* * * * *